United States Patent [19]

Baba et al.

[11] 4,102,001

[45] Jul. 25, 1978

[54] APPARATUS FOR REMOVING SOLIDS DEPOSITED ON INNER SURFACE OF ROTARY KILN

[75] Inventors: Takashi Baba, Matsudo; Susumu Hunahashi, Ryugasaki; Toshihiko Kawabata, Chiba, all of Japan

[73] Assignee: Kubota Ltd., Osaka, Japan

[21] Appl. No.: 778,960

[22] Filed: Mar. 18, 1977

[30] Foreign Application Priority Data

Mar. 18, 1976 [JP] Japan ..... 51-30638

[51] Int. Cl.[2] ..... B08B 9/08

[52] U.S. Cl. ..... 15/104.1 C; 15/56; 432/75

[58] Field of Search ..... 15/93 R, 104.1 C, 104.05, 15/104.16, 56, 57; 432/75; 431/122, 123

[56] References Cited

U.S. PATENT DOCUMENTS

| | | | |
|---|---|---|---|
| 1,220,827 | 3/1917 | Downs | 15/104.16 |
| 2,272,219 | 2/1942 | McCoy | 15/104.1 C |
| 2,911,662 | 11/1959 | Sedgwick | 15/104.1 C |
| 2,931,060 | 4/1960 | Kelly | 15/104.1 C |
| 3,667,743 | 6/1972 | Kovalcik et al. | 432/75 |

*Primary Examiner*—Edward L. Roberts
*Attorney, Agent, or Firm*—Armstrong, Nikaido, Marmelstein & Kubovcik

[57] ABSTRACT

An apparatus comprises an elongated boring bar having a cutting edge at its front end, an assembly coupled to the boring bar for reciprocally moving the boring bar axially of a rotary kiln, and an assembly for rotating the boring bar. The boring bar is advanced into the kiln with the cutting edge retracted from the kiln wall and, upon clearing the tuyere dam of the kiln, the cutting edge is brought close to the kiln wall by rotating the boring bar. The boring bar is then advanced again to scrape off and remove solid deposits from the kiln wall.

5 Claims, 6 Drawing Figures

APPARATUS FOR REMOVING SOLIDS DEPOSITED ON INNER SURFACE OF ROTARY KILN

BACKGROUND OF THE INVENTION

The solids deposited on the inner surface of rotary kilns are usually scraped off by periodically reciprocating a boring bar during the operation of the kiln. However, it is difficult to bring the cutting edge on the front end of the boring bar close to the wall of the kiln, because the boring bar merely travels reciprocally along the axis of the kiln. Especially with kilns which are provided with a tuyere dam of specified height at the outlet of the kiln to retain the feed to be treated, the boring bar can be brought close the kiln wall only to such an extent that the bar will not engage the tuyere dam, consequently permitting part of the solid deposits unremoved.

Since rotary kilns are equipped at the outlet with a burner for injecting a high-temperature gas, solids tend to lodge mainly on the outlet portion of the kiln. Accordingly, it has been highly desired to provide an apparatus for removing solid deposits from the kiln wall beyond the tuyere dam at the outlet of the kiln.

SUMMARY OF THE INVENTION

This invention provides an apparatus for removing solid deposits from the outlet portion of a rotary kiln which apparatus comprises an elongated boring bar having a cutting edge and coupled to reciprocating means and rotating means. When advancing into the kiln, the boring bar is rotated in one direction within the kiln, tilting the cutting edge to a position retracted from the dam of the kiln. After the cutting edge has cleared the dam, the edge can be brought close to the wall of the kiln irrespective of the presence of the dam by rotating the boring bar in the reverse direction. In this state, the boring bar is advanced to removed solid deposits.

An object of this invention is to provide an apparatus having a cutting edge which can be positioned close to the wall of a kiln to remove solid deposits from the wall.

Another object of this invention is to provide an apparatus adapted for use in a kiln having a projecting tuyere dam at its outlet portion, the apparatus being capable of removing solid deposits in the vicinity of the outlet portion beyond the tuyere dam.

DETAILED DESCRIPTION OF THE INVENTION

Figure 1:
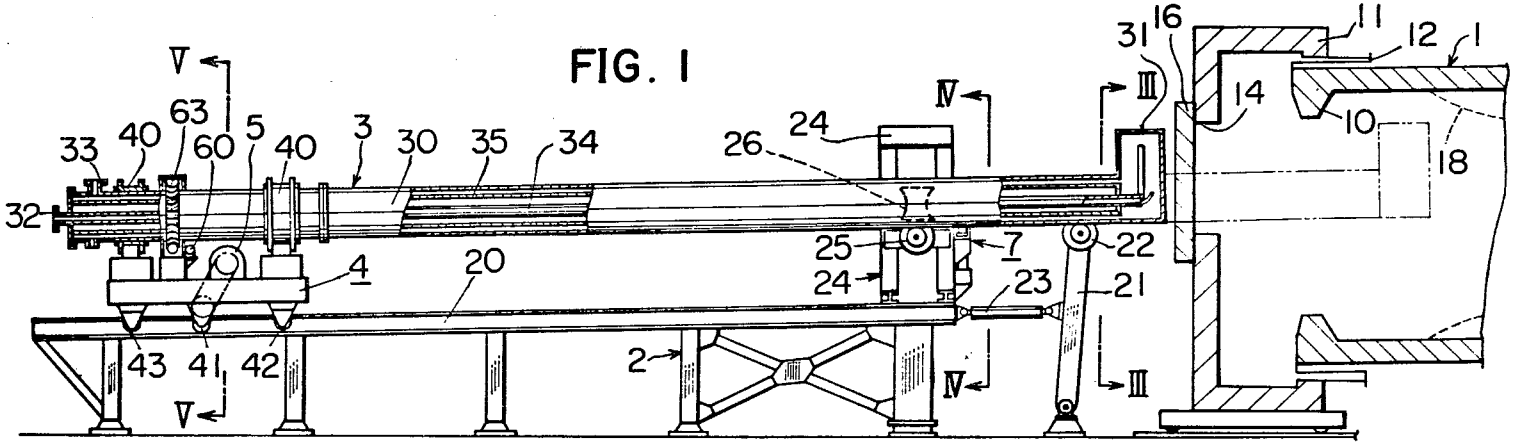
FIG. 1 is a front view partly broken away and showing a removing apparatus according to this invention.
Figure 2:
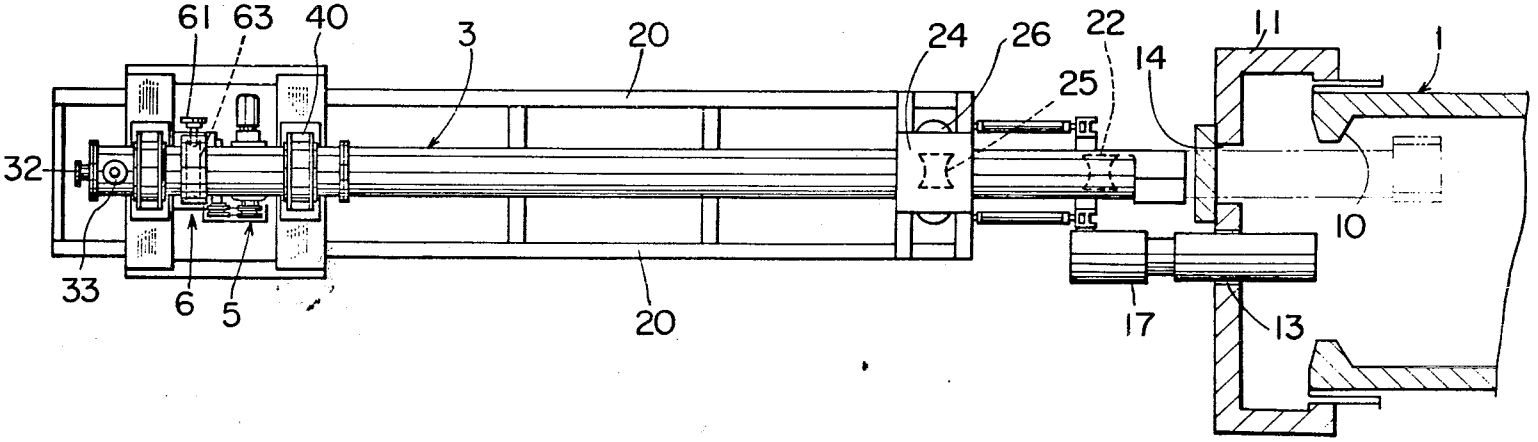
FIG. 2 is a plan view of the apparatus.
Figure 3:
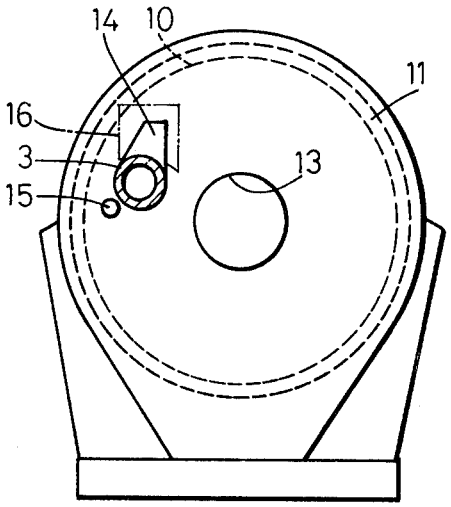
FIG. 3 is a view in section taken along the line III—III in FIG. 1.
Figure 4:
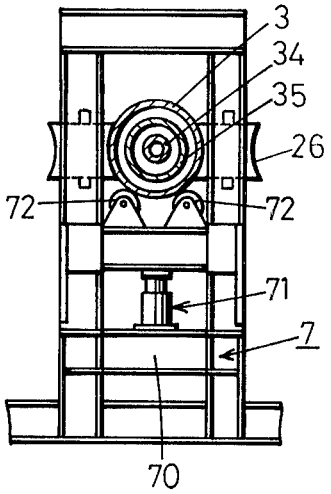
FIG. 4 is a view in section taken along the line IV—IV in FIG. 1.

This invention relates to an apparatus for removing solids deposited on the inner surface of rotary kilns for producing reduced iron and sintered ores, for reducing chrome and manganese ores, for producing lightweight aggregate, cement, dolomite and magnesia clinker by firing, etc.

A rotary kiln 1 has at its outlet a projecting tuyere dam 10 having a specified height of about 45 cm. A burner hood 11 is provided for the open outlet of the kiln, with a hermetic seal 12 interposed between the hood 11 and the peripheral wall of the kiln. A burner 17 extends through a center aperture 13 in the hood 11 to heat the outlet portion of the kiln to a high temperature. A bore 14 formed in the hood 11 eccentrically thereof has a configuration of a boring bar 3 a diameter approximate to the outside diameter of a boring bar 3. The hood 11 has a slidable shutter 16 for hermetically closing the bore 14 and an inspection hole 15 for observing the cutting operation of the cutting edge to be described below. A base frame 2 for the boring bar 3 is disposed to the front of the hood 11.

The base frame 2 supports guide rails 20 extending in parallel to the axis of the inclined kiln 1. The boring bar 3 is therefore movable in parallel to the wall of the kiln 1 along the guide rails 20. A front roller stand 21 connected by links 23 to the front portion of a support 24 carries at its upper end a roller 22 for reciprocally movably supporting the boring bar 3 from below.

The boring bar 3 is in the form of an elongated hollow cylinder 30 having a hollow cutting edge 31 at its front end and an inlet 32 and an outlet 33 for cooling water at its base end. A water duct 34 extends through the center of the cylinder 30 from the inlet 32 to the cutting edge 31. An inner tube 35 having a slightly smaller diameter than the cylinder 30 surrounds the water duct 34 concentrically therewith to provide a narrow water passage between the inner surface of the cylinder 30 and the inner tube 35. The front end of the inner tube 35 is closed immediately before the cutting edge 31. In the front half of the boring bar 3, a helical guide plate (not shown) extends through the water passage. The cooling water forced out from the front end of the water duct 34 enters the narrow passage between the inner tube 35 and the cylinder 30, helically flows through the passage along the guide plate and returns to the outlet 33.

The front portion of the boring bar 3 is reciprocally movably supported at its bottom by the roller 22 on the front roller stand 21 and by a lower roller 25 on the support 24 mounted on the front ends of the guide rails 20. The bar front portion is also reciprocally movably supported at its opposite sides by side rollers 26 on the support 24. The rear portion of the boring bar 3 is rotatably supported by bearings 40 on a carriage 4 adapted to travel on the guide rails.

The carriage 4 has large-diameter wheels 41 rollable on the guide rails 20 in engagement therewith and wheels 42 and 43 disposed to the front and rear of the wheels 41 and having a slightly smaller diameter than the large-diameter wheels 41. The carriage 4 is therefore reciprocally travelable on the guide rails 20 and slightly tiltable about the middle wheels 41.

Figure 5:
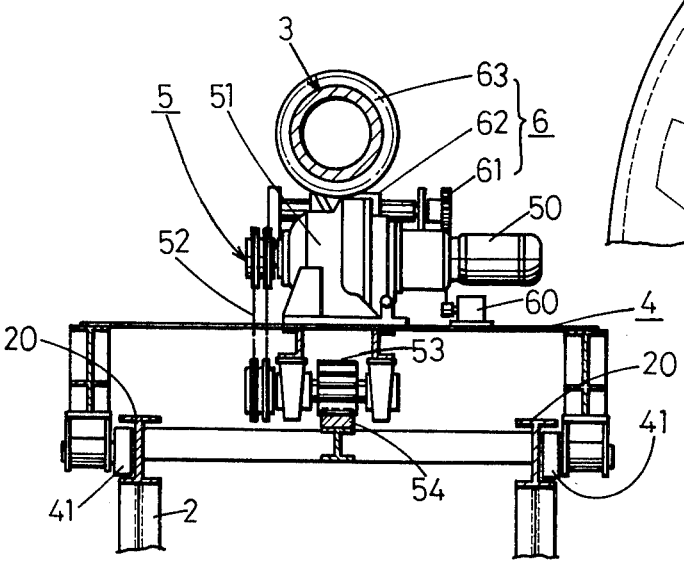
FIG. 5 is an enlarged view in section taken along the line V—V in FIG. 1.

The boring bar 3 is coupled to reciprocating means 5 and rotating means 6, whereby the boring bar 3 is reciprocally movable along the guide rails 20 and rotatable in positive and reverse directions. FIGS. 1 and 5 exemplify the reciprocating means 5 and rotating means 6. Midway between the guide rails 20, a rack 54 extends in parallel to the rails. The carriage 4 has a pinion 53 meshing with the rack 54. The pinion 53 is driven in positive and reverse directions by a motor 50 mounted on the carriage 4 by way of a reduction gear 51 and coupling means 52 to travel the carriage 4 along the slanting guide rails 20.

The boring bar 3 is provided around its base end portion with a worm wheel 63 meshing with a worm 62 on the carriage 4. A motor 60 drives the worm 62 via a sprocket wheel 61 to rotate the worm wheel 63 in positive and reverse directions, whereby the boring bar 3 is rotatable, tilting its cutting edge 31 through a desired angle.

In front of the support 24, there is disposed lifting means 7 including a lift 71 which has on its upper end rollers 72 rotatably supporting the boring bar 3 from below. When the boring bar 3 is to be rotated, the rollers 72 are first lifted to slightly raise the boring bar 3 from the lower roller 25 on the support 24.

Operation

Figure 6:
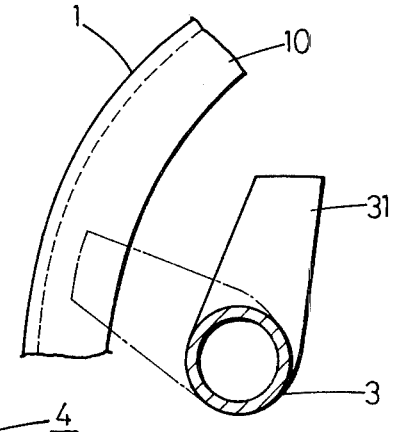
FIG. 6 is a sectional view showing a boring bar with its cutting edge cutting solid deposits on the wall of a kiln.

During the operation of the kiln 1, the boring bar 3 is held in its retracted position, with the cutting edge 31 in its inwardly tilted position within the kiln hood 11 as seen in FIGS. 1 and 6.

When solid deposits are formed on the inner surface of the kiln, the reciprocating means 5 is actuated to drive the pinion 53 in engagement with the rack 54, thereby advancing the carriage 4. When the cutting edge 31 has cleared the tuyere dam 10, the carriage 4 is brought to a halt.

Subsequently, the lift 71 of the lifting means 7 is operated, causing the upper end rollers 72 to support the boring bar 3 and raising the bar 3 from the front roller stand 21 and the support 24. At this time, the side rollers 26 on the support 24 are raised with the boring bar 3. The bar 3 is now positioned slightly above the rollers 22 and 25. Since the base end of the boring bar 3 is held by the bearings 40, the carriage 4 is slightly tilted by the operation of the lifting means 7 about the large-diameter wheels 41 within the range allowed by the clearance between the opposite rollers 42 and 43 and the flanges of the rails 20. The tilting of the carriage therefore permits the rise of the front portion of the boring bar 3.

Upon the rise of the front portion of the boring bar 3, the rotating means 6 on the carriage 4 starts to operate, causing the worm 62 to rotate the worm wheel 63 in meshing engagement therewith and thereby bringing the cutting edge 31 close to the kiln wall as indicated in the dot-and-dash line in FIG. 6.

After the depth the cutting edge 31 cuts the solid deposits 18 is adjusted by adjusting the angle of rotation of the bar 3, the lifting means 7 is retracted, whereby the rollers 72 on the lift 71 are lowered, allowing the boring bar 3 to bear on the roller 22 on the front roller stand 21 and the rollers 25 and 26 on the support 24 again. When the cutting edge 31 is brought to the proper cutting position, the reciprocating means 5 is driven again to drive the carriage 4 at a low speed in engagement with the guide rails 20.

The cutting edge 31 advances while cutting the solid deposits 18 on the surface of the kiln wall in operation and thereby removing the deposits from the wall.

While the boring bar 3 is being exposed to the high temperature in the hot portion of the kiln 1, cooling water is supplied to the inlet 32 at the base end of the boring bar 3 and injected into the interior of the cutting edge 31 to cool the edge portion. The water thereafter enters the passage between the concentric inner tube 35 and cylinder 30, helically flows through the passage while cooling the cylinder 30, and returns to the base end, from which the water is run off through the outlet 33. In this way, the water protects the boring bar 3 from the high temperature.

The feed rate of the cutting edge is suitably determined depending on the number of revolutions of the kiln and the hardness of the solid deposits. For example, satisfactory results were achieved by feeding the cutting edge at a low rate of 0.2 m/min to a rotary kiln for the production of reduced iron, having an inside diameter of 3.5 m and rotating at 0.7 r.p.m., for the removal of 300-mm-thick solid deposits on the kiln wall in a region beyond the dam extending over the distance of 4 to 7 m from the dam.

When the cutting edge has fully advanced through the kiln 1, completing the removal of the solid deposits, the lifting means 7 is actuated again to raise the boring bar 3 from the front roller stand 21 and the support 24. In this state, the cutting edge 31 is moved away from the kiln wall inwardly of the kiln by reversely rotating the rotating means 6. The lifting means 7 is then lowered, permitting the boring bar 3 to rest on the front roller stand 21 and the support 24.

Subsequently, the reciprocating means 5 is driven in the reverse direction to rapidly retract the carriage 4. Upon the return of the cutting edge 31 to the position of the burner hood 11, the carriage is halted. The boring bar 3 is held in this retracted position until the commencement of the next removing operation.

As already described, the boring bar 3 of this invention is rotated in positive and reverse directions within the kiln, whereby the cutting edge 31 is inwardly tilted to its retracted position when clearing the tuyere dam 10, whereas the cutting edge 31 is positioned close to the kiln wall by reversely rotating the boring bar 3 after the cutting edge 31 has cleared the dam 10. Accordingly, the cutting edge 31 can start to cut solid deposits at a position immediately before the dam for the removal of the deposits even if the dam has a great height.

What is claimed is:

1. An apparatus for removing solids deposited on the inner surface of a rotary kiln including guide rails extending toward a burner hood of the kiln in parallel to the axis of the kiln, an elongated boring bar reciprocally movably supported by the guide rails and having a cutting edge projecting from its front end, and reciprocating means operatively connected to the boring bar to move the cutting edge along the wall of the kiln for the removal of the solid deposit, the apparatus comprising rotating means operatively connected to the boring bar for rotating the boring bar in positive and reverse directions to thereby turn the cutting edge to suitable tilted positions, the rotating means being operable to tilt the cutting edge to an inward retracted position free of engagement with a tuyere dam on the kiln and to tilt the cutting edge to a projected position close to the kiln wall beyond the dam to cut the solid deposit on the kiln inner surface to a desired depth.

2. An apparatus as defined in claim 1 wherein the reciprocating means comprises a carriage rotatably supporting the boring bar and reciprocally travelable in engagement with the guide rails, a rack extending in parallel to the guide rails, and a motor for driving a pinion mounted on the carriage and meshing with the rack.

3. An apparatus as defined in claim 1 wherein the rotating means comprises a worm wheel provided around the peripheral surface of a cylindrical portion of the boring bar, a worm movable with the boring bar and meshing with the worm wheel, and drive means for rotating the worm in positive and reverse directions.

4. An apparatus as defined in claim 1 wherein the boring bar is in a form of an elongated hollow cylinder having a hollow cutting edge at its front end and an inlet and an outlet for cooling water at its base end, though a center of the cylinder extends a water duct from the inlet to the cutting edge, an inner tube having a smaller diameter than the cylinder surrounds the water tube to provide a narrow water passage between the inner surface of the cylinder and the inner tube.

5. An apparatus for removing solids deposited on the inner surface of a rotary kiln including guide rails extending toward a burner hood of the kiln in parallel to the axis of the kiln, an elongated boring bar reciprocally movably supported by the guide rails and having a cutting edge projecting from its front end, and reciprocating means operatively connected to the boring bar to move the cutting edge along the wall of the kiln for the removal of the solid deposit, the apparatus comprising rollers disposed under a front portion of the boring bar and reciprocally movably supporting the boring bar, rollers disposed under a front portion of the boring bar and rotatably supporting the boring bar, lift means operable in relation to the rollers of one of the two types to cause the rotatably supporting rollers or the reciprocally movably supporting rollers to support the boring bar, and rotating means operatively connected to the boring bar to rotate the boring bar in positive and reverse directions and to thereby turn the cutting edge to suitable tilted positions.

* * * * *